United States Patent [19]

Baril, Jr. et al.

[11] 4,070,505

[45] Jan. 24, 1978

[54] METHOD OF IMPARTING PARAMAGNETIC SUSCEPTIBILITY TO COTTON FIBERS

[75] Inventors: Albert Baril, Jr., Metairie; Mayer Mayer, Jr., New Orleans; Devron P. Thibodeaux, Metairie, all of La.

[73] Assignee: The United States of America as represented by the Secretary of Agriculture, Washington, D.C.

[21] Appl. No.: 660,882

[22] Filed: Feb. 24, 1976

Related U.S. Application Data

[63] Continuation-in-part of Ser. No. 448,422, March 4, 1974, abandoned.

[51] Int. Cl.[2] ..... H01F 10/04

[52] U.S. Cl. ..... 427/128; 427/47; 428/532; 428/900

[58] Field of Search ..... 428/900, 539, 532; 427/127–132, 48, 47

[56] References Cited

U.S. PATENT DOCUMENTS

| | | | |
|---|---|---|---|
| 2,582,590 | 1/1952 | Heeren et al. | 427/130 |
| 3,451,545 | 6/1969 | Studer | 209/8 |
| 3,672,991 | 6/1972 | Phillips | 117/235 |

OTHER PUBLICATIONS

Fritz et al., Dec. 5, 1960, pp. 6199–6200, vol. 82, J. Am. Chem. Soc., Com. to the Ed.

*Primary Examiner*—Bernard D. Pianalto
*Attorney, Agent, or Firm*—M. Howard Silverstein; David G. McConnoll; Salvador J. Cangemi

[57] ABSTRACT

Paramagnetic susceptibility has been imparted to raw unprocessed cotton fibers by impregnating the fibers with a paramagnetic organometallic rare earth compound dissolved in hydrocarbon solvent. The strength of the imparted property is sufficient to allow for the manipulation of the textile fibers by magnetic force fields in conjunction with radically new techniques of textile processing. The paramagnetic susceptibility is removable and whatever paramagnetic compound use is recoverable.

7 Claims, No Drawings

METHOD OF IMPARTING PARAMAGNETIC SUSCEPTIBILITY TO COTTON FIBERS

This is a continuation-in-part of Ser. No. 448,422, filed Mar. 4, 1974 and now abandoned.

FIELD TO WHICH THIS INVENTION RELATES

This invention relates to methods of imparting paramagnetic susceptibility to raw unprocessed cotton fibers. Specifically, this invention relates to the treatment of textile fibers with paramagentic compounds to yield a composite with significant magnetic properties. The ability to make textile fibers react to magnetic forces allows for nonmechanical fiber manipulation, including the moving, impelling and transporting of fibers in association with textile processing.

DEFINITION OF TERMS

The *magnetic susceptibility* of a substance is a quantitative measure of its magnetic properties. It refers to the degree of internal magnetization which results from a given external magnetizing field. Specific magnetic susceptibility as discussed here will be given the conventional electromagnetic units (e.m.u./gm).

For the purposes of this specification all magnetic materials may be considered to be from the category called *paramagnetic* substances. When a *paramagnetic* material is placed in a magnetic field it acquires a magnetization slightly larger than the external field and in the same direction as the field. The susceptibility of a paramagnet is positive and of the order of $10^{-4}$ e.m.u./gm.

A non-uniform magnetic field will exert a force on a material which is proportional to the mass of the sample, to its magnetic susceptibility, and to the strength of the field gradient. It is the ratio of this magnetic force to the weight of the material which will be referred to as the *magnetic force to sample weight ratio.* The technique used in this study to measure the magnetic susceptibility or magnetic force to sample weight ratio is known as the "Faraday Technique" (ref. Selwood, P.S., "Magnetochemistry," Interscience Publishers, New York, 2nd Ed., 1956, pp. 11–14). Faraday's method requires an electromagnet equipped with shaped pole tips designed to give the desired field gradient properties along with a sensitive analytical balance.

OBJECTIVES

The main object of the instant invention is to render fibers susceptible to magnetic force fields by the deposition of paramagnetic compounds into or onto raw unprocessed cotton fiber surfaces. Another objective of the instant invention is to provide a method of forming paramagnetic fiber composites from which the magnetic treatment is removable.

THE PRIOR ART

The prior art teaches that untreated fibers can be manipulated or processed ultrasonically (ref. Boucher et al, "Sonic and Ultrasonic irradiation of Cotton Fibers," *Textile Research J.,* Vol. 37 (Not. 8), August 1967, pp 621–643); aerodynamically (ref. Mayer et al, "Aerodynamics of Lint Cotton," *Textile Industries,* November 1966); and by electrostatic forces (Mayer et al, "Electrostatic Fiber Fractionation," *Textile Bulletin,* Vol. 91 (No. 3) pp 50–54, March 1965). Although the prior art teaches the several and different ways of manipulating and processing fibers by the use of various physical forces for application in some phase of textile processing, no single method has been found satisfactory by these researchers for substantial volume textile processing of fibers.

Prior to the disclosure of the present method of this invention no fiber has displayed the ability to react to a magnetic field in a manner suitable for the manipulation and processing of the fibers. Now we have discovered a novel approach, employing the application of certain materials to the fibers to render the fibers susceptible to magnetic force manipulation.

HOW THE OBJECTIVE IS ACHIEVED

One method by which this objective is accomplished is by the impregnation of one of several preferred paramagnetic compounds onto or into the raw unprocessed cotton fibers. Since paramagnetic behavior results from the net magnetic moment of unpaired inner-shell electrons, it is usually associated with transition elements. Of these, the paramagnetic rare earth group (consisting of the Lanthanide elements with incomplete 4f shells and atomic numbers between 58 and 69), and the iron group (incomplete 3d shell) contain elements having the largest paramagnetic susceptibilities. This method refers to the use of any sufficiently soluble compounds of these elements, regardless of whether the solvent be aqueous or non-aqueous.

The objective is accomplished by the impregnation of raw unprocessed cotton fibers with selected paramagnetic organometallic rare earth compounds. This method refers to the soaking of fibers in solutions of rare earth elements chelated in an organic complex and dissolved in typical hydrocarbon solvents such as benzene, chloroform, ethyl ether, hexane, or the equivalent. It has been discovered that the *rare earth organometallics* retain their *paramagnetic* properties when complexed to organic groups such as the acetyl-acetonates. The most promising results have been experienced with acetylacetonates of the rate earths dysprosium and holmium: $(CH_3COCHCOCH_3)_3Dy$ and $(CH_3COCHCOCH_3)_3Ho$. Although there are six ligand bonds for each rare earth atom these compounds showed magnetic susceptibility comparable to that obtained with rare earth chlorides. This indicates an effective shielding of the inner unfilled 4f shells of the rare earth atoms by the outer 5s and 5p shells. The magnetic susceptibility of these two compounds added to raw and pre-mercerized irrigated and rain-grown cotton fibers was determined to be sufficient to allow for manipulation of the fibers in magnetic force fields.

Specifically, it has been found that soaking fibers in solutions of rare earth organometallics in benzene or chloroform with concentrations between 1% and 10% yields fibers with magnetic susceptibility of about from $10^{-6}$ to $10^{-5}$ e.m.u./gm. The organometallics can be removed from the fibers by solvent-extractions with benzene, chloroform, hexane, ethyl ether, and other non-polar solvents, and the recovery of the organometallics thus achieved.

The following examples are provided to illustrate the preferred embodiments of the invention and should not be construed as limits to the invention in any manner whatever.

EXAMPLE 1

Tufts of raw irrigated cotton fibers weighing 100 mg were soaked for two hours in 10% chloroform solutions of dysprosium acetylacetonate [($CH_3COCH$-

$COCH_3)_3Dy]$ and holmium acetylacetonate $[(CH_3COCHCOCH_3)_3Ho]$. The tufts were then removed from the solutions, blotted, and the solvent evaporated in air. After equilibration overnight, the fibers were weighed to determine percentage uptake of the rare earth organometallic compound. Paramagnetic properties were measured using the Faraday technique and the results of these measurements are summarized in Table I.

TABLE 1

| Treatment Compound | Percent Add-on Of Paramagnetic Compound | Paramagnetic Susceptibility (emu/gm) | Magnetic Force To Weight Ratio |
|---|---|---|---|
| $(C_5H_7O_2)Dy$ | 61.4 | $53.96 \times 10^{-6}$ | 0.270 |
| $(C_5H_7O_2)Ho$ | 47.9 | $50.60 \times 10^{-6}$ | 0.251 |

EXAMPLE 2

Tufts of raw rain-grown cotton fibers weighing 100 mg were soaked for two hours in 1.3% benzene solutions of dysprosium acetylacetonate $[(CH_3COCHCOCH_3)_3Dy]$ and holmium acetylacetonate $[(CH_3COCHCOCH_3)_3Ho]$. The tufts were then removed from the solutions, blotted, and the solvent evaporated in air. After equilibration overnight, the fibers were weighed to determine percentage uptake of the rare earth organometallic compound. Paramagnetic properties were measured using the Faraday technique and the results of these measurements are summarized in Table II.

TABLE II

| Treatment Compound | Percent Add-on Of Paramagnetic Compound | Paramagnetic Susceptibility (emu/gm) | Magnetic Force To Weight Ratio |
|---|---|---|---|
| $(C_5H_7O_2)Dy$ | 18.2 | $12.62 \times 10^{-6}$ | .062 |
| $(C_5H_7O_2)Ho$ | 11.9 | $13.06 \times 10^{-6}$ | .065 |

We claim:

1. A method of imparting paramagnetic susceptibility to raw unprocessed cotton fibers to provide a means of manipulating said fibers in a magnetic force field, the method consisting essentially of:
   a. impregnating cotton fibers with a solution consisting of about from 1% to 10% by weight of a paramagnetic organometallic rare earth compound selected from the group consisting of dysprosium acetylacetonate and holmium acetylacetonate dissolved in an organic solvent selected from the group consisting of benzene, chloroform, ethyl ether, and hexane; and
   b. drying the wet impregnated cotton fibers to obtain fibers with a paramagnetic susceptibility of about from $10^{-6}$ to $10^{-5}$ electromagnetic units per gram (emu/gm) which is sufficient to render the fibers reactive to magnetic forces.

2. The process of claim 1 wherein the organometallic compound is dysprosium acetylacetonate.

3. The process of claim 1 wherein the organometallic compound is holmium acetylacetonate.

4. The process of claim 1 wherein the solvent is chloroform.

5. The process of claim 1 wherein the solvent is ethyl ether.

6. The process of claim 1 wherein the solvent is benzene.

7. The process of claim 1 wherein the solvent is hexane.

* * * * *